US007806035B2

(12) United States Patent
Kaiser et al.

(10) Patent No.: US 7,806,035 B2
(45) Date of Patent: Oct. 5, 2010

(54) SAFETY VENT DEVICE

(75) Inventors: Garry R. Kaiser, Spring, TX (US); Colby W. Ross, Hockley, TX (US); Tracy L. Graham, Conroe, TX (US); Mark L. Sloan, Bellville, TX (US)

(73) Assignee: Baker Hughes Incorporated, Houston, TX (US)

( * ) Notice: Subject to any disclaimer, the term of this patent is extended or adjusted under 35 U.S.C. 154(b) by 6 days.

(21) Appl. No.: 12/137,671

(22) Filed: Jun. 12, 2008

(65) Prior Publication Data

US 2008/0307951 A1 Dec. 18, 2008

Related U.S. Application Data

(60) Provisional application No. 60/943,648, filed on Jun. 13, 2007.

(51) Int. Cl.
*E21B 43/116* (2006.01)

(52) U.S. Cl. ..... 89/1.15; 175/4.54

(58) Field of Classification Search ..... 89/1.15; 175/4.54–4.59; 166/55, 297
See application file for complete search history.

(56) References Cited

U.S. PATENT DOCUMENTS 2,530,805 A * 11/1950 Bond ..... 175/4.58
3,057,297 A * 10/1962 Brown ..... 175/4.6
3,327,630 A 6/1967 Bell
3,404,699 A * 10/1968 Arons ..... 137/73
3,842,919 A 10/1974 Dermott
3,931,855 A * 1/1976 Vann et al. ..... 166/128
4,330,039 A * 5/1982 Vann et al. ..... 166/297
4,554,981 A * 11/1985 Davies ..... 175/4.52
4,640,354 A * 2/1987 Boisson ..... 166/250.01
4,678,044 A * 7/1987 Luke et al. ..... 175/4.52
4,790,385 A 12/1988 McClure et al.
4,800,958 A 1/1989 Haugen et al.
4,881,445 A 11/1989 Hayes
4,896,690 A * 1/1990 Taylor ..... 137/73
5,044,388 A 9/1991 Barton et al.
5,318,126 A * 6/1994 Edwards et al. ..... 166/297
5,571,986 A * 11/1996 Snider et al. ..... 102/275.11
5,603,384 A * 2/1997 Bethel et al. ..... 175/4.54
5,967,410 A * 10/1999 Lammers ..... 236/93 R
6,588,508 B2 * 7/2003 Parrott et al. ..... 166/297

(Continued)

OTHER PUBLICATIONS

PCT International Search Report dated Oct. 07, 2008.

(Continued)

*Primary Examiner*—J. Woodrow Eldred
*Assistant Examiner*—Gabriel J Klein
(74) *Attorney, Agent, or Firm*—Bracewell & Giuliani LLP

(57) ABSTRACT

A perforating gun system having a relief system for relieving high pressure during unexpected high temperature or situations that may produce rupture of the gun body. The relief system may be responsive either to high temperatures as well as high pressures. In the high temperature situation, the relief system has a fuseable link that melts thereby allowing movement of a piston to open vent communication between the inside of a gun body in the ambient conditions. Similarly, a pressure device includes a piston responsive to pressure that moves under high pressure within the gun body thereby exposing a port enabling communication between the inside of the gun body and the ambient conditions.

11 Claims, 6 Drawing Sheets

U.S. PATENT DOCUMENTS

| | | | | |
|---|---|---|---|---|
| 6,722,424 | B2 * | 4/2004 | Broad | 166/55.1 |
| 7,121,340 | B2 | 10/2006 | Grove et al. | |
| 7,360,487 | B2 * | 4/2008 | Myers et al. | 102/275.12 |
| 7,600,568 | B2 * | 10/2009 | Ross et al. | 166/297 |
| 2003/0217770 | A1 * | 11/2003 | Schultz et al. | 137/73 |
| 2005/0072578 | A1 * | 4/2005 | Steele et al. | 166/386 |
| 2007/0284118 | A1 * | 12/2007 | Benton | 166/386 |
| 2008/0134922 | A1 * | 6/2008 | Grattan et al. | 102/206 |
| 2008/0264647 | A1 * | 10/2008 | Li | 166/373 |

OTHER PUBLICATIONS

The International Search Report and the Written Opinion for PCT/US2008/066818 Dated Dec. 17, 2009.

* cited by examiner

SAFETY VENT DEVICE

RELATED APPLICATIONS

This application claims priority to and the benefit of co-pending U.S. Provisional Application Ser. No. 60/943,648, filed Jun. 13, 2007, the full disclosure of which is hereby incorporated by reference herein.

BACKGROUND

1. Field of Invention

The invention relates generally to the field of oil and gas production. More specifically, the present invention relates to a safety vent valve. Yet more specifically, the present invention relates to a safety vent valve for a perforating gun system.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

One typical example of a perforating system 4 is shown in FIG. 1. As shown, the perforating system 4 comprises one or more perforating guns 6 strung together to form a perforating gun string 3, these strings of guns can sometimes surpass a thousand feet of perforating length. Connector subs 18 provide connectivity between each adjacent gun 6 of the string 3. Many gun systems, especially those comprised of long strings of individual guns, are conveyed via tubing 5. Others may be deployed suspended on wireline or slickline (not shown).

Included with the perforating gun 6 are shaped charges 8 that typically include a housing, a liner, and a quantity of high explosive inserted between the liner and the housing. When the high explosive is detonated, quickly expanding explosive gases are formed whose force collapses the liner and ejects it from one end of the charge 8 at very high velocity in a pattern called a "jet" 12. The jet 12 perforates the casing and the cement and creates a perforation 10 that extends into the surrounding formation 2. The resulting perforation 10 provides fluid communication between the formation 2 and the inside of the wellbore 1. In an under balanced situation (where the formation pressure exceeds the wellbore pressure) formation fluids flow from the formation 2 into the wellbore 1, thereby increasing the pressure of the wellbore 1. Moreover, as the explosive gases cool and contract, a large pressure gradient is created between the inside of the perforating gun body 14 and the wellbore 1. This pressure differential in turn draws wellbore fluid within the perforating gun body 14 through gun apertures 16.

FIGS. 2*a* and 2*b* illustrate a portion of a gun string 3 for providing additional detail of the connector sub 18 disposed between the two perforating guns 6. As shown, the connector sub 18 has a protruding member 19 on each of its ends formed to mate with a corresponding recess 21 provided on the end of each perforating gun 6. The guns 6 as shown are secured to the connector sub 18 by a series of threads 23 formed on the inner diameter of the recesses 21 and the outer diameter of the protruding member 19.

Also disposed within the gun string is a detonating cord 20 for providing an initiating/detonating means for the shaped charge 8. Detonation of the shaped charge 8 is accomplished by activating the detonating cord 20 that in turn produces a percussive shockwave for commencing detonation of the shaped charge explosive 8. Typically the shockwave is initiated in the detonating cord 20 at its top end (i.e. closest to the surface 9) and travels downward through the gun string 3. To ensure propagation of the shockwave to each individual gun 6 making up the gun string 3, each connecting sub 18 is also equipped with a section of detonating cord 20. The section of detonating cord 20 in the connecting sub 18 resides in a cavity 22 formed therein. Transfer charges 24 on the end of each segment of the detonating cord 20 continue travel of the shock wave from the end of one gun body 6, to the section of detonating cord 20 in the connecting sub 18, from the connecting sub 18 to the next adjacent gun body 6, and so on. The shock wave transfer function of the transfer charges 24 produces a passage 26 between the gun bodies 6 and the connecting sub 18. As shown in FIG. 2*b*, the shaped charge 8 detonates in response to exposure of the shock wave produced by the detonating cord 20. Detonation of the shaped charge 8 in turn leaves an aperture 16 that provides fluid flow from the wellbore 1 to inside of the gun body 14. Similarly, detonation of the transfer charges 24 in response to the detonating cord shock wave, creates the passage 26 provides a fluid flow conduit between the inside of the perforating gun bodies 6 and the connecting sub cavity 22. Accordingly, the cavity 22 is subject to wellbore pressures subsequent to exposure of the detonating cord shock wave. Often the debris within the wellbore fluid can be carried with the fluid into the cavity 22. When retrieving the gun system 4 from the wellbore 1, the cavities 22 will be vertically oriented that in turn can allow the fluid debris to collect within the passages 26 thereby creating a potential clogging situation that can trap the wellbore fluid within the connecting sub 18. Since the wellbore fluid pressure can often exceed 1000 psi, this trapped pressure can present a personnel hazard during disassembly of the gun string 3. Therefore, an apparatus and method for eliminating the potential for trapped pressure within the connecting sub 18 is needed.

Perforating gun strings are typically assembled at a manufacturing facility then shipped to the job site. Sometimes the assembled gun strings are stored before use at the manufacturing facility, at an intermediate location during shipping, or at the job site. The explosives used in the shaped charges are reactive at high temperatures and may begin to expel gasses when heated. The gun body may become excessively heated when exposed to fire, prolonged direct sunlight, as well as other heat sources. This off gas situation may occur for temperatures as low as 400° F. Since the gun bodies are pressure sealed to prevent inflow of wellbore fluids, explosive off gassing due to heating can increase gun body pressure past its burst pressure. Accordingly a need exists to maintain gun body pressure below its burst pressure.

SUMMARY OF INVENTION

The present disclosure concerns a venting system for a perforating gun string. The venting system may comprise a piston responsive to a temperature rise experienced by the perforating gun string. Optionally, the present device may include a piston that is responsive to increased pressure experienced by the inner portion of the gun system. The temperature responsive piston may include a fusible pin that degrades under high temperature thereby allowing movement of the piston that in turn opens a communication port between the gun body and the outer surrounding environment. Similarly, the piston may also respond to high pressure that shears a shear pin securing the piston allowing piston movement, wherein the piston movement places a relief port that vents the high pressure of the gun system outside of the gun system.

BRIEF DESCRIPTION OF DRAWINGS

Some of the features and benefits of the present invention having been stated, others will become apparent as the description proceeds when taken in conjunction with the accompanying drawings, in which.

Figure 1:
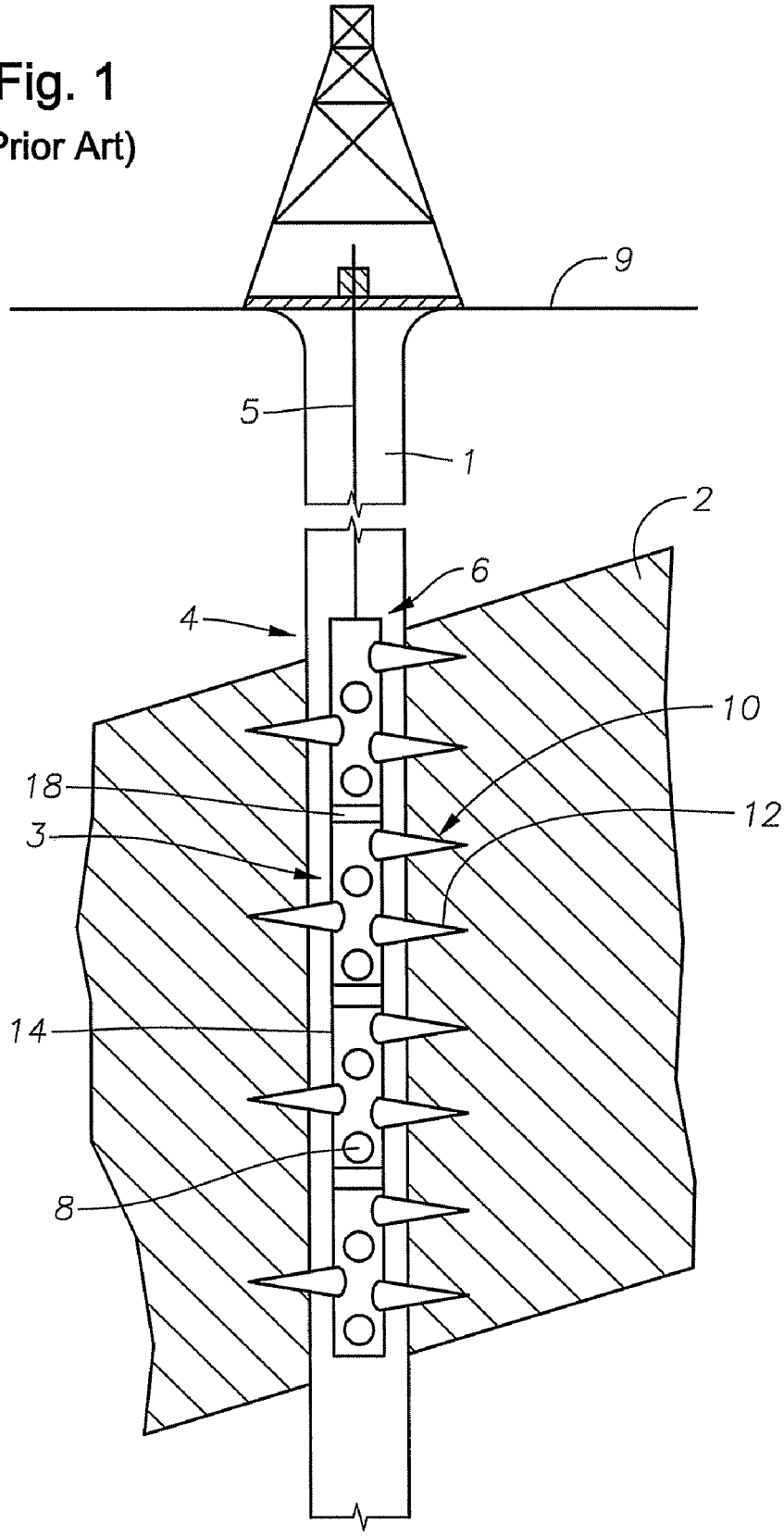
Fig. 1 (Prior Art)
FIG. 1 is a partial cutaway side view of a perforating system.
Figure 2A:
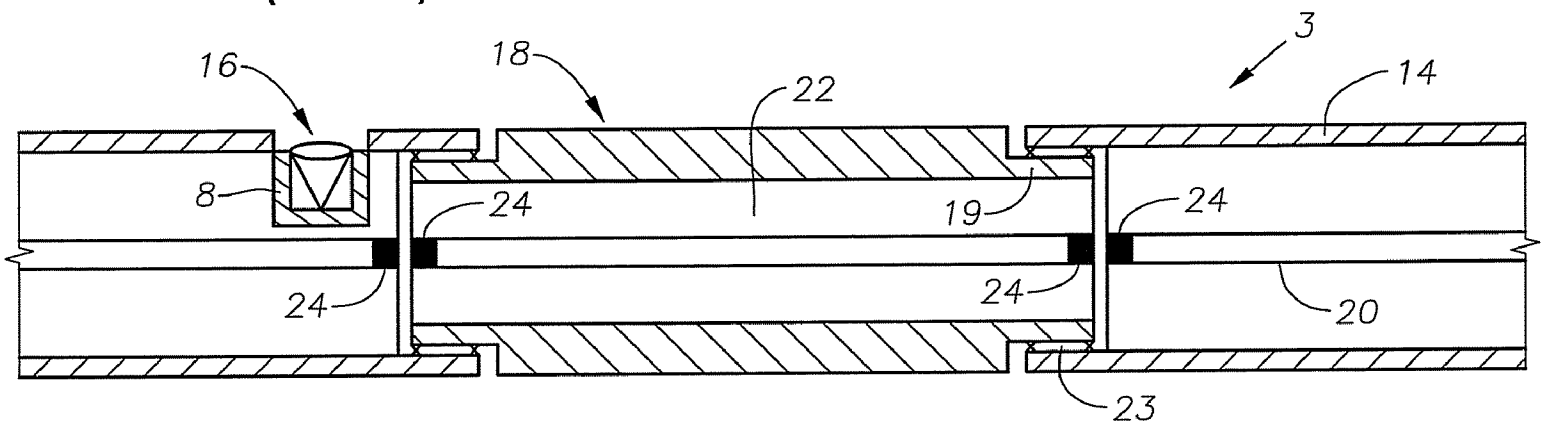
Fig. 2A (Prior Art)
FIG. 2A illustrates a partial cutaway of a portion of a perforating string.
Figure 2B:
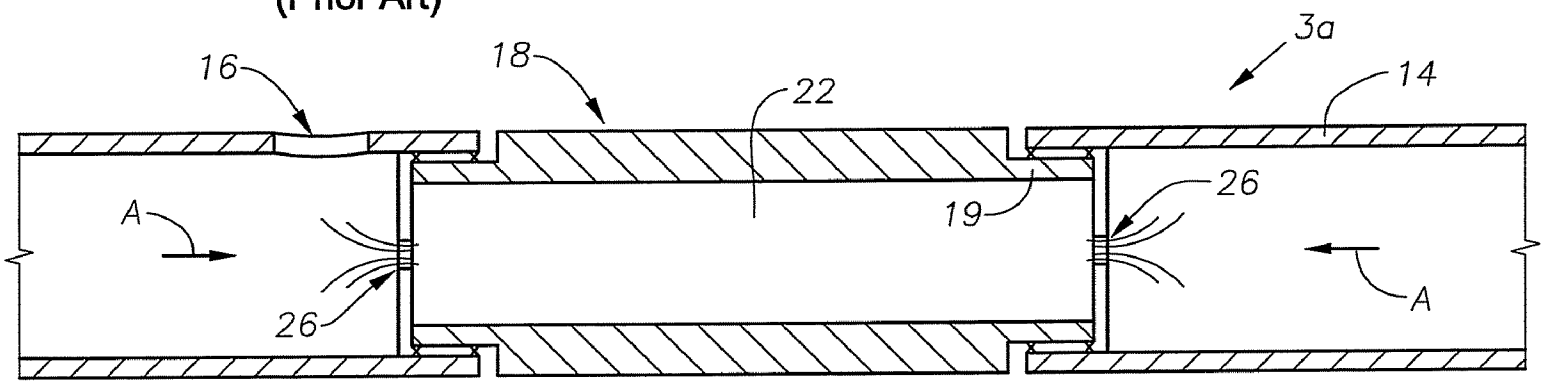
Fig. 2B (Prior Art)
FIG. 2B depicts a partial cutaway of a portion of a perforating string.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The present disclosure concerns a vent system for use with a perforating gun string. In one embodiment, the vent system comprises a valve disposed within one of, a perforating gun body, a connector that connects subsequent gun bodies, or optionally within one of the end connectors of the perforating string. Operation of the vent system may be in response to conditions within a portion of or the entire perforating gun string. The conditions include an increase in temperature experienced by the gun system and/or an increase in pressure seen by the gun system.

Figure 3A:
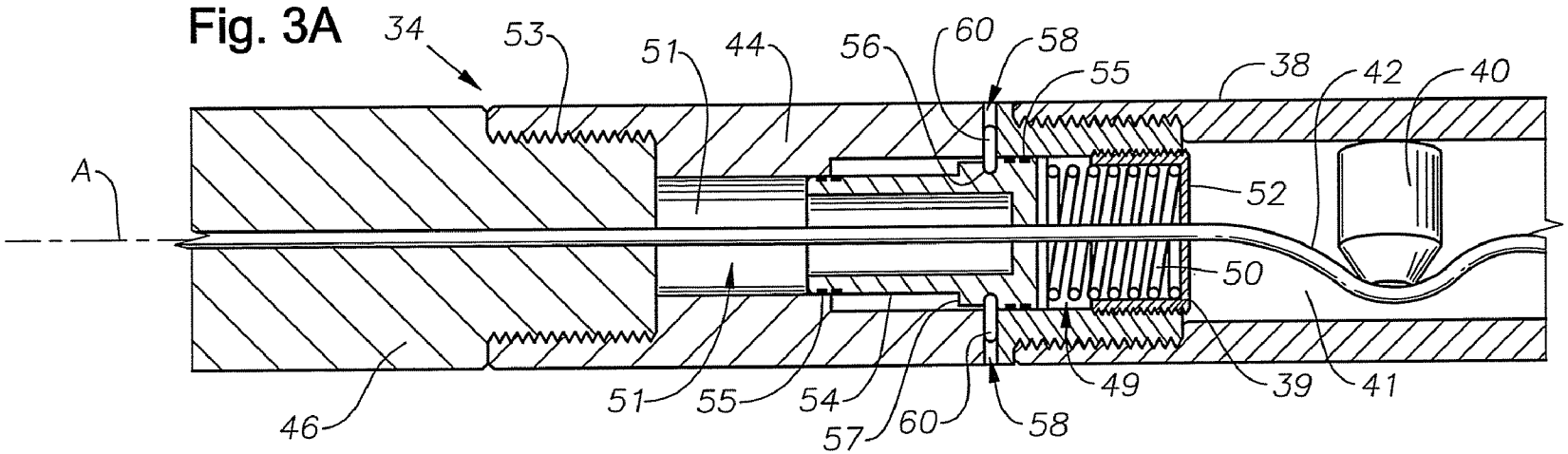
FIG. 3A is a partial cutaway side view of a portion of an embodiment of a perforating string having a relief system.

In FIG. 3A, one embodiment of a perforating gun string 34 in accordance with the present disclosure is shown in a partial side cutaway view. The section of the string 34 shown comprises a portion of a gun body 38, a connector 44, and an additional member 46. In this embodiment, the member 46 could be another connector, such as an upper or lower section of a gun string or another gun body. A shaped charge 40 is shown attached to a detonation cord 42. The shaped charge 40 and detonation cord 42 are disposed in a cavity 41 formed in the gun body 38. The detonation cord 42 travels substantially along the axis of the connector 44 and the adjacent member 46. A passage 48 is shown formed coaxial within the body of the connector 44. The passage 48 comprises an upper section 49 and lower section. 51. The upper section 49 diameter is greater than the lower section 51 diameter.

A spring 50 with a hold down nut 52 is shown coaxially situated within the upper portion 49. In this embodiment, the hold down nut 52 has a generally cup like shape that forms over one end of the spring 50 and is optionally threaded on its outer radial surface for a threading connection within the connector sub 44. Thus, assembly of the spring 50 within the connector sub 44 would occur before the sub 44 is connected with the gun body 38. Assembly comprises inserting the spring 50 into the upper section 49 placing the open end of the hold down nut 52 over the spring 50. The nut 52 then engages the threads 39 located within the outer radial surface of the upper section 49. Tightening the hold down nut 52 within these threads 39 then draws the spring 50 downward into the compressed state as shown in FIG. 3A. Optionally, other devices may be used in place of the spring 50; these include elastomeric materials, compressible fluids, and memory metals. Thus anything capable of storing a potential energy can be interchangeable with the spring 50.

A piston 54, also coaxially situated within the connector sub 44 and in this embodiment is disposed within the upper section 49. The compressed spring force exerts its potential energy against the upper surface of the piston 54. The piston 54 has slots 56 formed along its lateral surface that correspond with slots 58 formed radially inward from the outer surface of the connector sub 44. Optionally the slots (56, 58) can be radially formed as well as having a rectangular cross section. As shown in FIG. 3A, a retaining member couples the piston 54 to the gun body 38, in this embodiment the retaining member comprises a shear screw 60 disposed in slot 58 that also extends into slot 56 to retain the piston 54 in place. While two shear screws 60 are shown, this function could be accomplished with a single shear screw or more than two shear screws.

Seals 55 are shown provided on the piston 54 outer radial surface thereby disposed between the slots (56, 58) and the spring 50. In this embodiment, the piston 54 outer diameter decreases along a profile 57 thereby defining the boundary between the upper portion 49 and lower portion 51. Thus, the piston 54 upper section has an outer diameter largely the same as the upper section 49 inner diameter. Similarly, the piston 54 lower section outer diameter largely corresponds with the lower portion 51 inner diameter. Seals 55 may also be provided on the piston 54 lower section outer radial face to provide a sealing surface between the opposing surfaces. Threads 53 are disposed on the lower portion of the connecting surface of the connector sub 44 for mechanically coupling the connector 44 with the adjacent member 46.

Figure 3B:
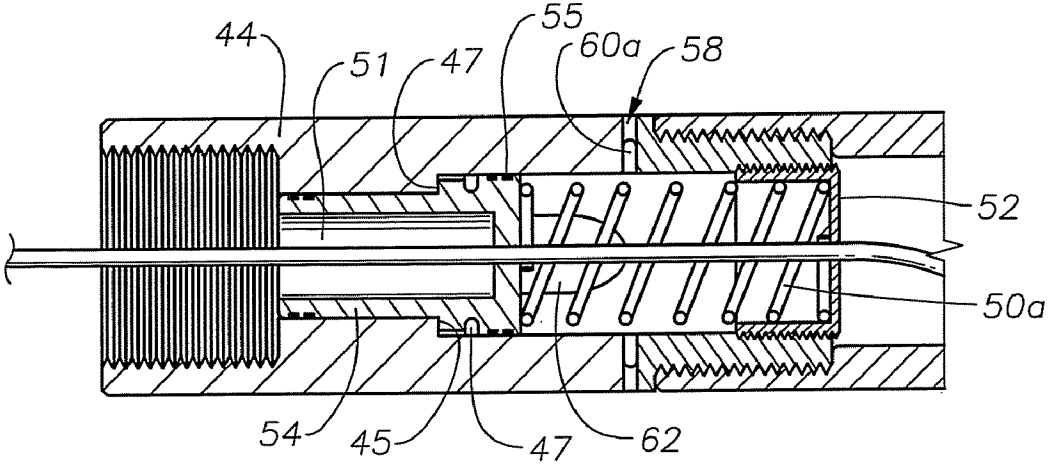
FIG. 3B is a partial cutaway side view of a portion of an embodiment of a perforating string having an actuated relief system.

In the embodiments of FIGS. 3A and 3B, the shear screw 60 is formed of a material responsive to a change in ambient conditions. More specifically, the material may respond to a temperature change experienced by the shear screw 60, where the temperature change can be a temperature increase or decrease. The material response can be a change in the material property; the material density, or material shape. Examples of material property changes include strength (such as shear strength, tensile strength, or compressive strength), modulus of elasticity, density, conductivity, piezoelectric constant, ductility, to name but a few. In one embodiment, the shear screw 60 material responds to temperatures below the temperature(s) where other perforating gun system materials respond or are damaged due to a temperature change. In another embodiment, the shear screw 60 material responds to a temperature below the reactive temperature of the explosives used in the gun body. In another embodiment, the shear screw 60 material has a melting point lower than the melting point of other materials making up the perforating gun string 34. In another embodiment, the shear screw 60 material has, as described below, a melting point below the reactive temperature of the explosives used in the gun body. Examples of shear screw 60 material include a metal, a memory material (including a memory metal), a polymeric material, an elastomeric material, or a material such as Nylon®. Example metals include those that soften or melt in response to the above described temperature change, lead is one example of a softening metal. Examples of specific temperatures where the retaining member material responds include about 205° C. (400° F.) up to about 535° C. (1000° F.) and all temperatures within this range.

FIG. 3B illustrates action of the current embodiment as a result of exposure to a temperature increase. The temperature increase may be to a damaging temperature or a dangerously high temperature. A damaging temperature is one capable of resulting in any damage to the gun system 34. As discussed previously, dangerously high temperatures include temperatures that may result in a potentially explosive situation. An explosion may occur due to experiencing a certain pressure as well as a temperature buildup within the confines of the gun string 34. For example, during shipping and/or storage, perforating systems may be exposed to a fire where a temperature increase not only expands gasses within the gun system (such as air within gun body cavity 41) but can also cause "off gassing" of the explosive material that further contributes to an undesirable pressure situation.

FIG. 3B illustrates a pressure relieving function of an embodiment of the present device. In this view, the shear screw 60A is formed of a material responsive to a temperature change. The temperature change may include a temperature rise where the corresponding material response is a reduced material strength. In the embodiment shown, the shear screw 60A has been sheared by the piston 54 after being degraded by an experienced temperature rise. The strength degradation is obviously material dependent and can be non-linear with respect to changing temperature. The strength degradation may occur at a material transition temperature, such as the glass transition temperature or the melt transition temperature. Sufficient degradation of the shear screw 60A material ultimately allows the applied force of the piston 54 and spring 50 to surpass the shear screw 60A material strength. The spring 50 pushed piston 54 shears the shear screw 60A enabling the piston 50 to travel through the passage 48. Continued urging by the spring 50 seats the piston 54 against a bulkhead at the lower terminal end of the lower portion 51. Piston 54 movement exposes a vent 62 that allows pressure communication with the gun system cavities and its surrounding environment. Thus as shown in FIG. 3A the piston 54 is in a first position and functions as a vent seal that seals the vent 62 from the cavity 41 and when unseated into a second position allows pressure communication between the vent 62 and the cavity 41. However embodiments other than the piston 54 can be employed as the vent seal. Gun system 34 cavities include any open void in the gun system 34 where a fluid could become trapped. Accordingly, the high pressure in the gun string 34 can be vented out of the gun system 34 thereby averting rupture of the gun body 38 or connector 44. Thus using a fusible member is one embodiment of a vent relief system for a perforating gun string that is responsive to temperature or thermal energy.

It should be pointed out that the spring side of the piston head is typically at the same pressure of the gun body 38. Thus in normal operating conditions, whether at surface or downhole, this pressure would be substantially the same as ambient surface conditions. In contrast, the lower portion 51 is exposed to the ambient conditions as seen by the gun string 34 outer surface. Thus while downhole the lower portion 51 is exposed to wellbore pressure, which exceeds ambient surface pressure. Accordingly during normal downhole deployment, this pressure gradient on the piston 54 pushes it up against the spring 50. This keeps the spring 50 in its compressed state and prevents pressure communication between the gun string inner bore and the wellbore. This occurs even when the shear screw 60 material has responded to an ambient condition and retains insufficient material strength to retain a spring 50 pushed piston 54. The screw 60 material degradation can occur because of high wellbore temperatures that soften the shear screw 60 thereby eliminating its ability to retain the piston 54 in place. However, as the gun string 34 is removed from the wellbore, the pressures will begin to equalize on the lower and upper ends of the piston 54, until the spring force exceeds any pressure differential and pushes the piston 54 into the lower portion 51. Should the gun string 34 have high pressure trapped therein during the perforating sequence, the high pressure can be released from within the gun system before it is a danger to retrieval personnel.

Figure 6A:
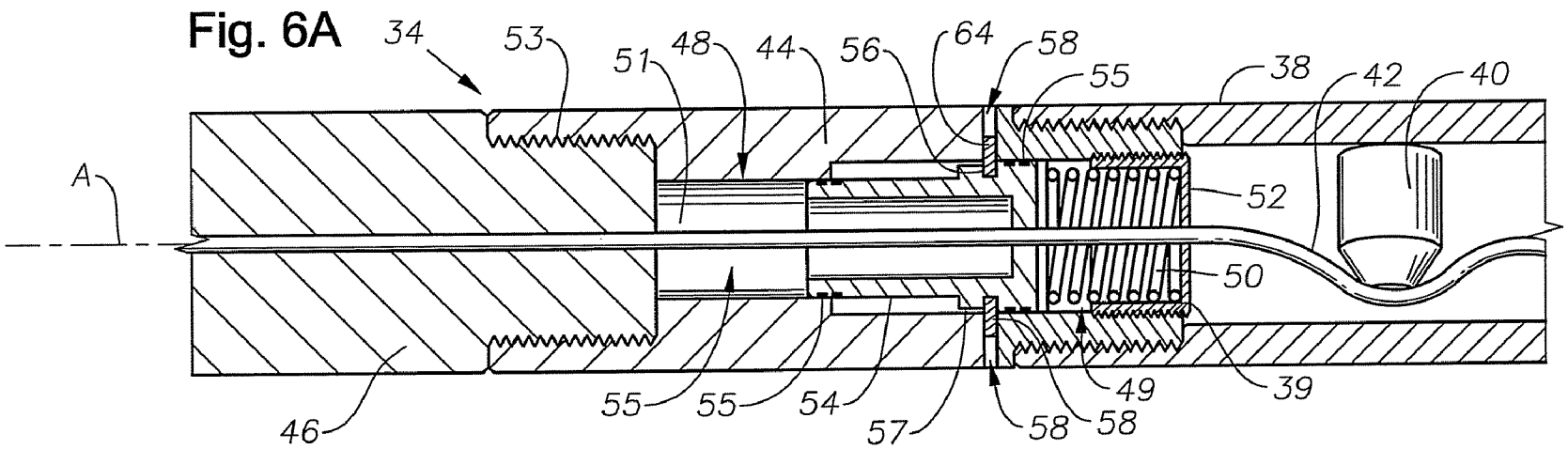
FIGS. 6A and 6B illustrate in a side sectional view an alternative embodiment of a retaining member.
Figure 6B:
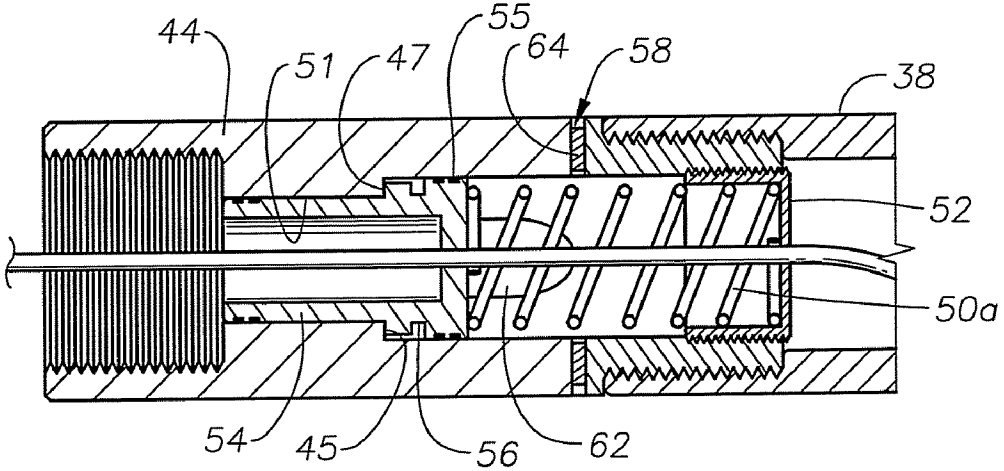

FIGS. 6A and 6B illustrate in a side sectional view an alternative embodiment of a retaining member. In the embodiment of FIG. 6A the retaining member comprises a ring 64 disposed in the slot 58 that extends into slot 56. The ring 64 is formed from a temperature responsive material and can expand with a temperature increase. The ring 64 material can be a standard metal, or a memory metal, where the ring 64 material transition point can be set below a temperature potentially damaging to the gun string 34. The ring 64 can be a single member with a split that expands or contracts in response to a temperature change. For example, as illustrated in FIG. 6B, the ring 64 has expanded to reside in slot 58 and out of slot 56 thereby de-coupling the piston 54 from the gun body 38 and allowing the piston 54 to move to a venting position. Optionally if the ring 64 is made from a material that contracts in response to a temperature change, such as a temperature rise, the ring 64 could move from the slot 58 into slot 56, which also de-couples the piston 54 from the gun body 38 to allow the piston 54 to slide into a vent position. It is well within the capabilities of those skilled in the art to identify or manufacture suitable contracting or expanding metals as described herein.

Figure 4A:
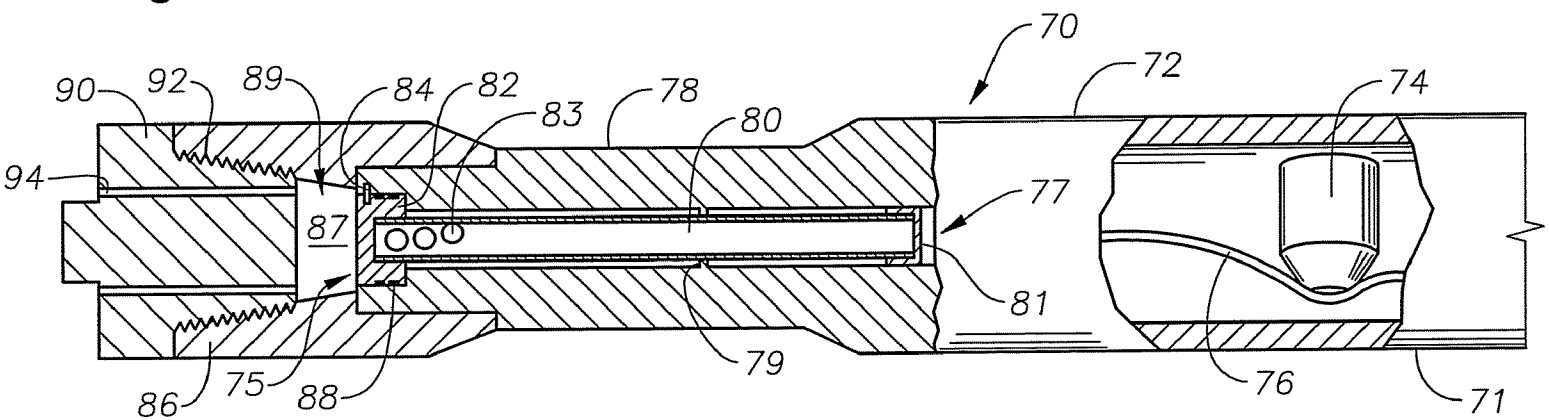
FIG. 4A is a side view of a portion of an embodiment of a perforating string having a relief system.

In FIG. 4A, another embodiment of a portion of a perforating gun string 70 is shown in a side partial cutaway view. In this embodiment, a vent system is shown that provides venting through an end section of a perforating gun 71. Here, the perforating gun 71 comprises a perforating gun body 72, a shaped charge 74, and a detonating cord 76. This gun body 72 is connectable with an end sub 78, also referred to herein as a bearing rest. Coaxially formed through the bearing rest is a passage 77 in which a vent tube 80 is disposed. As shown, a connector 86 is threadingly secured on the terminal end of the end sub 78. The connector 86 has a series of threads 92 formed in a frusto-conical opening 89 on its lower end. To protect these threads 92 during shipping, a thread protector 90 may be secured to the connector 86. A plenum 87 is shown in the base section of the connector opening 89. Ports 94 are shown axially formed within the thread connector 90. The ports 94 allow for pressure communication between the plenum 87 and the outer surface of the thread connector 90.

With reference to the embodiment of the vent tube 80 of FIG. 4A, as shown it is an elongated tubular member having an optional end cap 81 on its upper end (i.e. the end proximate to the gun body 72). The end cap 81 outer diameter exceeds the vent tube 80 diameter. However, the end cap 81 diameter should be less than the inner diameter of the passage 77 for allowing axial movement of the vent tube 80 within the passage 77. On the opposite end of the vent tube 80 is a vent plug 82 providing a pressure seal on that terminal end of the vent tube 80. The vent plug 82 has a largely cylindrical configuration and is formed to fit in a correspondingly cylindrical opening 75 on the terminal end of the end sub 78. A shear key 84 is shown coupling the vent plug 82 to the body of the end sub 78. Seals 88 are shown formed on the outer radius of the end cap to provide a sealing surface between the vent plug 82 and the end sub opening 75. The retaining member for affixing the vent plug 82 (or piston) in the first or sealing position, can optionally comprise the ring configuration described above. Formed on the outer surface of the annular portion of the vent tube 80 are vent holes 83. As will be discussed below, these vent holes 83 should be formed on the vent tube 80 proximate to the vent plug 82.

Figure 4B:
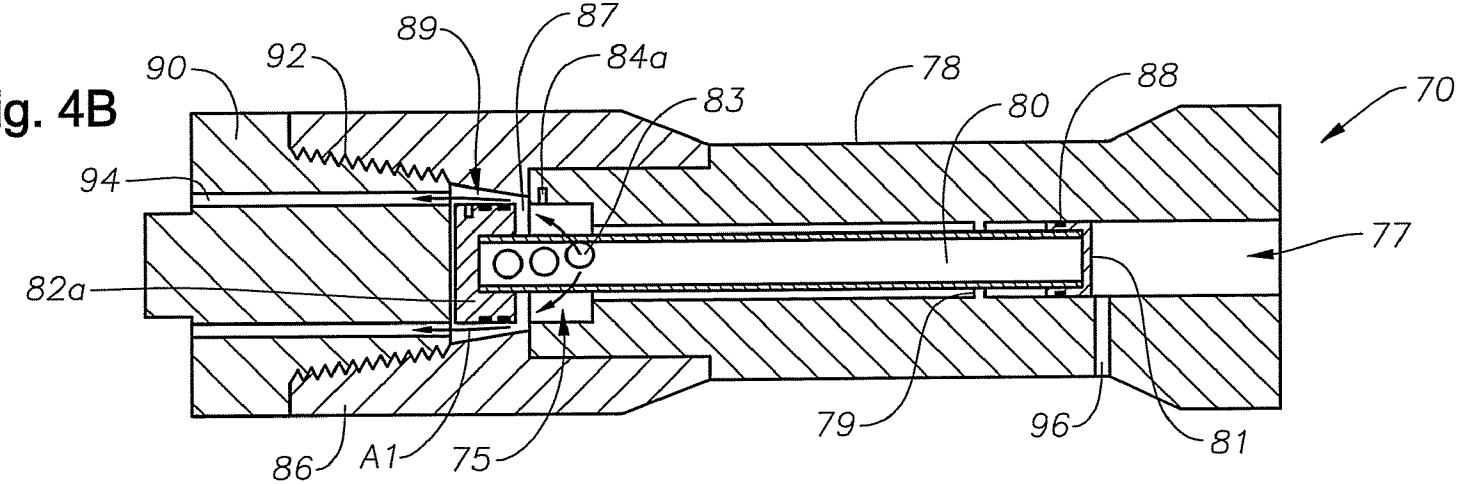
FIG. 4B is a partial cutaway side view of a section of an embodiment of a perforating string having an actuated relief system.

FIG. 4B is a cross sectional view of the embodiment of FIG. 4A illustrating operation of the vent tube 80 during an upset condition when high pressure may be experienced in the body 72 of the perforating gun 71. In this embodiment, high pressure in the perforating gun 71 communicates through the passage 77, through the vent tube 80, and ultimately impinges on the lower surface of the end cap 82. The high pressure pushes the vent tube 80 assembly downward unseating the end cap 82 from the sub opening 75 into the plenum 87. In this configuration, the vent holes 83 are in pressure communication with the plenum area thereby allowing pressure communication within the vent tube 80 to the plenum 87. Thus pressure build up in the perforating gun string 70 can be relieved through the vent holes 83, into the plenum 87, and through the ports 94.

As discussed previously, the outer diameter of the end cap 81 extends out into close proximity to the inner diameter of the passage 77. A series of lands 79 are shown formed on the inner circumference of the passage 77. Thus sufficient axial movement of the vent tube assembly within the end sub 78 causes end cap 81 contact with the lands 79. The lands 79 may prevent ejecting the vent tube 80 from within the end sub during a high pressure situation. It should be pointed out that other embodiments exist, wherein instead of a thread protector 90, a connection for disposing the gun string within a wellbore may be coupled with the end sub 78. Optionally, the vent tube 80 may be comprised of a material that responds to a temperature increase by thermally expanding. In one embodiment, a thermally expansive vent tube 80 is secured at its lower end and by its thermal expansion it sufficiently elongates to push the end cap 82 into the plenum 87 thereby allowing pressure communication between the plenum 87 and the passage 77. Alternatively, a thermal expansive rod may replace the vent tube 80; thermally expanding the rod also urges the end cap 82 into the plenum 87 to create pressure communication between the passage 77 and the plenum 87.

An optional port 96 is shown formed within the end sub 78 extending from its outer surface into the passage 77. Thus, in situations when high pressure may urge the vent tube 80 past this port 96, the port 96 may provide an additional exit path for the high pressure generated within the perforating gun string. Seals 88 between the vent tube and passage, upstream of the port 96, prevent pressure communication between the port 96 and the gun body 72. Accordingly, this relief device may be relied upon in situations during shipping of the system, as well as storage and as well as use.

Figure 5:
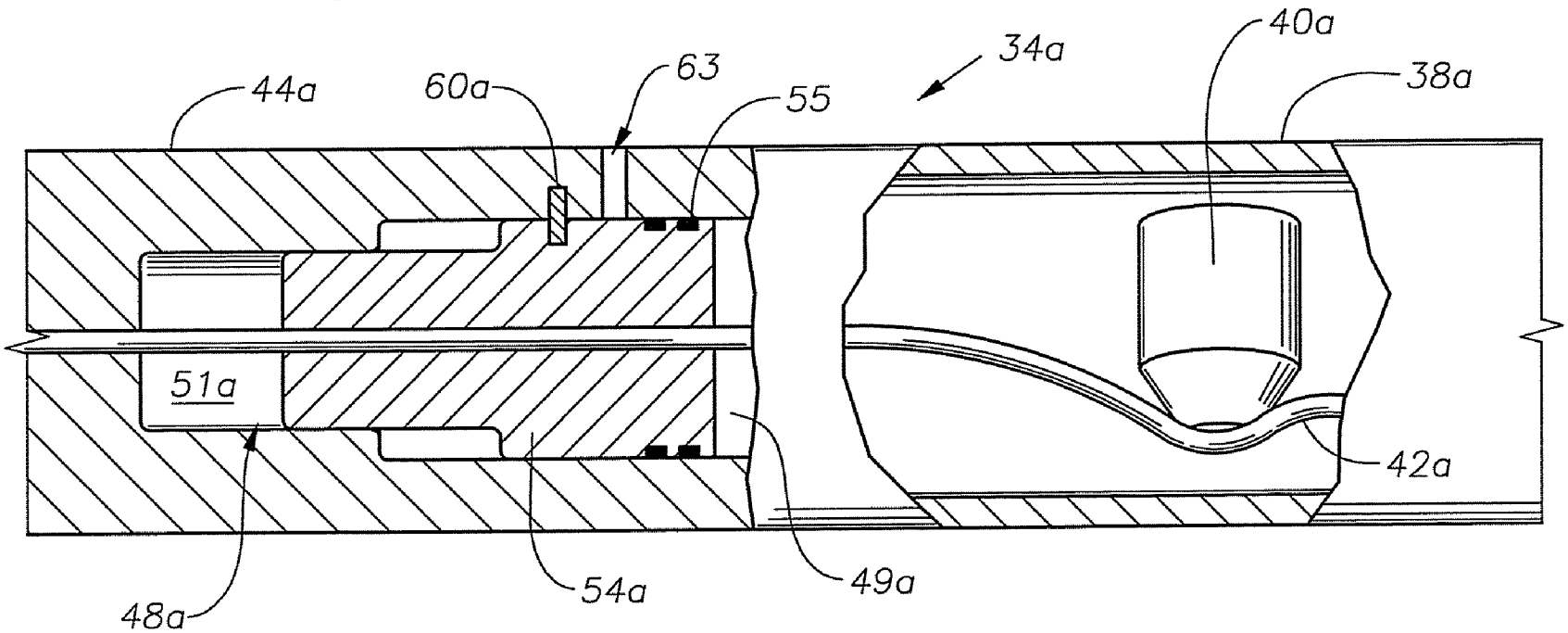
FIG. 5 is an alternative embodiment of a gun string having a relief system.

FIG. 5 provides a side partial cross sectional view of an embodiment of a perforating gun string 34*a* having a relief system. In this embodiment, the string comprises a gun body 38*a* coupled with a connector 44*a*. The gun body 38*a* includes a shaped charge 40*a* and connected to a detonation cord 42*a*. The detonation cord 42*a* may be disposed through the connector 44*a* as well. The relief system here comprises a piston 54*a* disposed within a passage 48*a*. The piston 54*a* may be maintained in place with a shear screw 60*a* for preventing movement of the piston. As shown, the passage 48*a* comprises an upper section 49*a* and a lower section 51*a* distinguished by a change in inner diameter of the passage 48*a*. Pressure in the section of the upper portion 49*a* between the piston 54*a* and the gun body 38*a* is substantially equal to gun body pressure. In situations when gun body pressure may approach gun body yield strength, the high pressure may impinge on the piston 54*a* and urge it within the passage 48*a* moving it to fill the lower portion 51*a*. The shear screw 60*a* is set to shear at a force below the force applied by the piston 54*a* when the piston is pushed by a pressure at or close to the gun body (or connector) yield strength. Setting the shear screw 60*a* fracture force at this value prevents damage to the gun body 38*a*. Upon shearing of the shear pin 60*a*, the piston 54*a* moves along the passage 48*a* thereby exposing the upper portion 49*a* with the vent 63. Thus, movement of the piston past the vent 63 allows the high pressure within the gun body 38*a* to flow out of the system into the ambient area and thereby relieving pressure within the system. Seals 55 are shown on the outer surface of the piston between the passage and the upper portion of the piston. The seals 55 thereby isolate the inner section of the gun body 38*a* against wellbore fluids that may try to migrate into that area. As such, a relief system employing a piston moveable by a pressure imbalance is one example of a relief system responsive to pressure.

The relieving devices and systems illustrated herein are not limited to the embodiments shown. Each relief system can be employed in any portion of a gun string, i.e. a gun body, a connector for connecting successive gun bodies, or a connector at either end of a gun string. Moreover, the present disclosure includes gun string embodiments having a single one of the above described relief systems, all above described relief systems, or all combinations thereof. Additionally, while the piston 54 is shown generally coaxial with the gun string 34, the scope of the present disclosure includes embodiments where the piston 54 is oblique to the gun string 34 axis A.

What is claimed is:

1. A perforating system comprising:

a perforating gun string having a housing;

a cavity within the perforating gun string;

a gun body disposed in the gun string;

a shaped charge housed in the gun body; and a relief system comprising, a piston in the cavity, a vent formed through a sidewall of the housing adjacent the piston, a frangible retaining member inserted into registered slots in the housing and the piston and that is formed from a material that degrades at a temperature below a temperature that degrades any other part of the perforating string, and a spring biased against the piston, so that when the frangible retaining member degrades due to temperature, the spring urges the piston away from the vent so the cavity is in pressure communication with a space ambient the housing.

2. The perforating system of claim 1, wherein the material of the frangible retaining member degrades at a temperature ranging from about 205° C. to about 535° C.

3. The perforating system of claim 1, wherein the material of the frangible retaining member degrades at a temperature of at least about 205° C.

4. The perforating system of claim 2, wherein the components of the perforating string, other than the frangible retaining member, begin to degrade at a temperature greater than about 535° C.

5. The perforating system of claim 1, further comprising a high explosive in the shaped charge that expels gases at a temperature greater than the temperature that degrades the frangible retaining member.

6. The perforating system of claim 1, further comprising a detonating cord disposed coaxially within the housing and that is circumscribed by the piston and the spring.

7. The perforating system of claim 1, further comprising a connecting sub attached to the gun body and wherein the cavity and piston are disposed in the connecting sub.

8. A perforating gun comprising:

a housing;

a cavity in the housing;

a shaped charge in the housing;

a vent formed through the housing;

an annular piston coaxially disposed in the housing blocking fluid communication between the vent and the cavity and coupled in place with a shear pin made from a material that experiences a decrease in strength at a temperature that does not decrease the strength of any other component of the perforating gun; and a resilient member that exerts a biasing force against the piston, so that when the perforating gun is heated to the temperature that decreases the strength of the material making up the shear pin, the biasing force can fracture the shear pin to uncouple the piston from its location so that the cavity is in fluid communication with the vent.

9. The perforating system of claim 8, wherein the material of the shear pin degrades at a temperature ranging from about 205° C. to about 535° C. and the components of the perforating string, other than the frangible retaining member begin to degrade at a temperature greater than about 535° C.

10. The perforating system of claim 8, the components of the perforating string, other than the shear pin begin to degrade at a temperature greater than about 205° C.

11. The perforating system of claim 8, further comprising a detonation cord, wherein the piston and resilient member circumscribe the detonation cord.

* * * * *